US008430050B2

(12) United States Patent
Luo et al.

(10) Patent No.: US 8,430,050 B2
(45) Date of Patent: Apr. 30, 2013

(54) SYSTEM AND METHOD FOR DECK-TO-COLUMN CONNECTION FOR EXTENDABLE DRAFT OFFSHORE PLATFORMS

(75) Inventors: Michael Y. H. Luo, Bellaire, TX (US); Anil K. Sablok, Houston, TX (US)

(73) Assignee: Technip France, Courbevoie (FR)

( * ) Notice: Subject to any disclaimer, the term of this patent is extended or adjusted under 35 U.S.C. 154(b) by 188 days.

(21) Appl. No.: 13/033,699

(22) Filed: Feb. 24, 2011

(65) Prior Publication Data

US 2012/0216737 A1 Aug. 30, 2012

(51) Int. Cl.
*B63B 35/44* (2006.01)

(52) U.S. Cl.
USPC ..... 114/265

(58) Field of Classification Search ..... 114/258–267
See application file for complete search history.

(56) References Cited

U.S. PATENT DOCUMENTS 4,966,496 A * 10/1990 Stelzer, Jr. ..... 405/227
6,718,901 B1 4/2004 Abbott et al.
6,865,791 B2 * 3/2005 Cook et al. ..... 29/447
7,037,044 B2 5/2006 Xu et al.
2005/0084336 A1 4/2005 Xu et al.

OTHER PUBLICATIONS

Flygare, E., International Search Report for International Patent Application No. PCT/US2012/026650, European Patent Office, dated Jul. 6, 2012.
Flygare, E., Written Opinion for International Patent Application No. PCT/US2012/026650, European Patent Office, dated Jul. 6, 2012.

* cited by examiner

*Primary Examiner* — Daniel Venne
(74) *Attorney, Agent, or Firm* — Locke Lord LLP

(57) ABSTRACT

The disclosure provides a system and method for locking and unlocking an extendable column to a deck. A deck-to-column connection assembly includes a pawl and shim used in a sequential de-ballasting and ballasting of the column to the deck that can easily lock and unlock the column with the deck. Generally, the locking method includes ballasting the column to insert a pawl between the column and the deck, de-ballasting the column to raise the column relative to the deck and create a vertical gap between the column and the deck, inserting a shim to fill the gap and secure the pawl in a deployed position, and further de-ballasting the column to raise the deck connected to the column. Generally, the unlocking method lowering the deck to float on water, de-ballasting the column to remove compressive stress on the shim, removing the shim, ballasting the column, and retracting the pawl.

16 Claims, 10 Drawing Sheets

SYSTEM AND METHOD FOR DECK-TO-COLUMN CONNECTION FOR EXTENDABLE DRAFT OFFSHORE PLATFORMS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure taught herein relates generally to a system and method for assembly and deployment of an extendable draft platform for deepwater offshore exploration and production of oil and gas, and more specially, relates a connection and locking system between a deck and columns.

2. Description of the Related Art

The development of deep water offshore oil and gas fields, such as are found in the Gulf of Mexico and the North Sea, present substantial challenges to the industry. Early production schedule requirements favor onshore or near shore integration and commissioning and a year-round deployment capability. Moreover, the ability to use so-called "dry trees" and steel catenary risers ("SCRs") requires that the motion of the deployed structures be relatively small, even in rough seas.

One type of offshore platform that has met with commercial success in deep water applications is the semi-submersible platform. Conventional semi-submersible platforms, however, are subject to motions that make it difficult, or even impossible, to support the various types of risers that are employed in such platforms. Deep draft semi-submersible platforms have been proposed that would exhibit superior motion characteristics. One type of deep draft semi-submersible platform is known as the extendable draft platform, or "EDP." The typical EDP comprises a buoyant equipment deck having a plurality of openings ("leg wells") through the deck. The deck may conveniently be rectangular or triangular, with a leg well at each corner or apex, although other configurations may be used. A buoyancy column or "leg" is installed in each of the leg wells that can be ballasted, for example, with seawater. The columns are initially installed in a raised position, and then lowered to a submerged position when the EDP has been moved to a deeper water site. Each column is divided by longitudinal internal bulkheads and horizontal flats (decks) into a plurality of compartments, the compartments including generally known system for introducing water into them for ballasting purposes when the columns are lowered to their submerged positions. Further, a heave plate pontoon assembly is generally attached to the bottom of the columns that helps to stabilize the EDP against the heave action of waves and swells. Examples of prior art EDPs are disclosed in U.S. Pat. No. 6,718,901 and U.S. Pat. No. 7,037,044.

An attachment or connection mechanism between the deck and columns needs to allow the downward movement of the columns relative to the deck as the columns are lowered to their deployed, submerged position prior to the attachment or connection of the columns to the deck. The attachment or connection mechanism generally should not interfere with the column lowering process. However, once the columns are lowered to their submerged position, the tops of the columns need to support the deck, so that as the columns are raised after connection to the deck, the deck is supported above the water surface. It is important that the attachment or connection of the columns to the deck be secure enough to withstand the strong forces that sea currents, rough waves, and wind often apply to the EDP.

Prior art has provided various solutions to connecting the columns to the deck. For example, in U.S. Pat. No. 6,718,901, the legs in a deployed position support the deck by moving a pawl from the legs to a position in compression or shear under the deck. Chains using winches pull the legs to the deck. Because the pawl only stops the legs from moving upward relative to the deck, the system is dependent on the chains to hold the deck and legs together, so that the legs do not move downward relative to the deck. The deck can be more permanently connected to the legs, such as by welding after deployment, which would need cutting off to be able to retract the legs at a later time when the EDP is moved.

U.S. Pat. No. 7,037,044 has several embodiments that generally depend on a locking pin engaging an aperture; or a column that can be temporarily positioned and welded to the deck. The locking pins can bend under the load or under a shear stress from ballasting or de-ballasting the column to support the deck above the water surface and cause difficulties in removal; the weldments need cutting off to be able to disconnect the column from the deck when the EDP is moved; and the tapered load on the actuation means can compromise the ability to maintain the tapered shear key in position so that an unintended upward movement of the column relative to the deck can occur. Other systems have used a rack-and-pinion lowering systems which can be locked in various ways.

While prior art approaches have provided satisfactory results, further improvements in the connection/attachment mechanisms have been sought, so as better to achieve the intended results.

There remains a need for a different system and method for allowing movement and locking and unlocking of the columns with the deck in an EDP or other offshore platform.

BRIEF SUMMARY OF THE INVENTION

The disclosure provides a system and method for locking and unlocking an extendable column to a deck that is movable relative to the deck to an operating position. A deck-to-column connection assembly can be used to lock the column with the deck and generally includes a pawl in an initially retracted position in either the deck or column when the column is not deployed to an operational position. The pawl can be moved from the column or deck to the other member (deck or column, respectively) to restrict a movement of the column relative to the deck in one direction. An initial over-ballasting of the column can allow the pawl to be deployed and a vertical gap to be created between the deck and a cantilever portion of the column over the deck, and a shim can be inserted in the gap while retaining the pawl in the deployed position. With the pawl restricting movement of the column relative to the deck in one direction and the shim restricting movement of the column in the other direction, the pawl remains engaged with the deck and column, so that the deck and column remains locked for subsequent columnar movements during operations. This locking in both directions does not depend on a continued need for an actuator to maintain the locked condition. With the columns connected to the deck, the columns can be de-ballasted to raise the deck until the EDP reaches its design draft at an operational position. To release the column from the deck, there is no need to cut off any weldments or to carefully balance the ballast to release upward and downward shear stresses on pins to release the pins. Generally, the method includes lowering the deck to float on the water surface by ballasting the columns, then at least partially de-ballasting the columns, if required to remove compressive stress on the shim on each column, removing the shim, then ballasting the columns and retracting the pawl. The columns are thus simply disconnected and released from the deck. The column can then be de-ballasted after the pawl is retracted to raise the column above the deck for towing to a new location and redeployment or for other purposes.

The disclosure provides a method of locking and unlocking an extendable column with a deck for an offshore floating platform with a deck-to-column connection assembly, the column having a top and a perimeter and a column pocket formed in a surface of the perimeter, the deck having a deck pocket circumferentially aligned with the column pocket, and the deck-to-column connection assembly having a pawl coupled to the column or deck and selectively retractable in the column pocket or deck pocket, a first actuator means coupled to the pawl, a column cantilever extending outward from the column beyond the column perimeter and overlapping a deck surface, a removable shim, and a second actuator means coupled to the shim, the method comprising: when the column is in an at least partially ballasted first position, moving a pawl sideways with the first actuator means so that the pawl is engaged in both the column pocket and the deck pocket with an amount of vertical pocket clearance remaining in at least one of the pockets; at least partially de-ballasting the column to a second position to decrease the amount of vertical pocket clearance from the first position; creating a gap between the column cantilever and the deck surface limited by the amount of vertical pocket clearance in the first position; and inserting the shim in the gap with the second actuator means, thereby restraining the column from moving relative to the deck to increase the vertical pocket clearance to the amount in the first position, and thereby securing the pawl within the column pocket and the deck pocket to lock the column with the deck.

The disclosure also provides a system for locking and unlocking an extendable column with a deck for an offshore floating platform, comprising: a column capable of being ballasted and de-ballasted, the column having a perimeter and a column pocket formed in a surface of the perimeter; a buoyant deck capable of being connected with the column; the deck having a deck pocket circumferentially aligned with the column pocket; and a deck-to-column connection assembly. The deck-to-column assembly comprises: a pawl coupled to the column or deck and selectively retractable in the column pocket or deck pocket and selectively engagable with the deck pocket or column pocket, respectively; an actuator means coupled to the pawl to move the pawl between a retracted position and extended position relative to the pockets; a column cantilever extending outward from the column beyond the column perimeter and overlapping a deck surface; a removable shim; and an actuator coupled to the shim and capable of inserting the shim between the column cantilever and the deck surface to secure the pawl in the column pocket and the deck pocket.

DETAILED DESCRIPTION OF THE INVENTION

Figure 1:
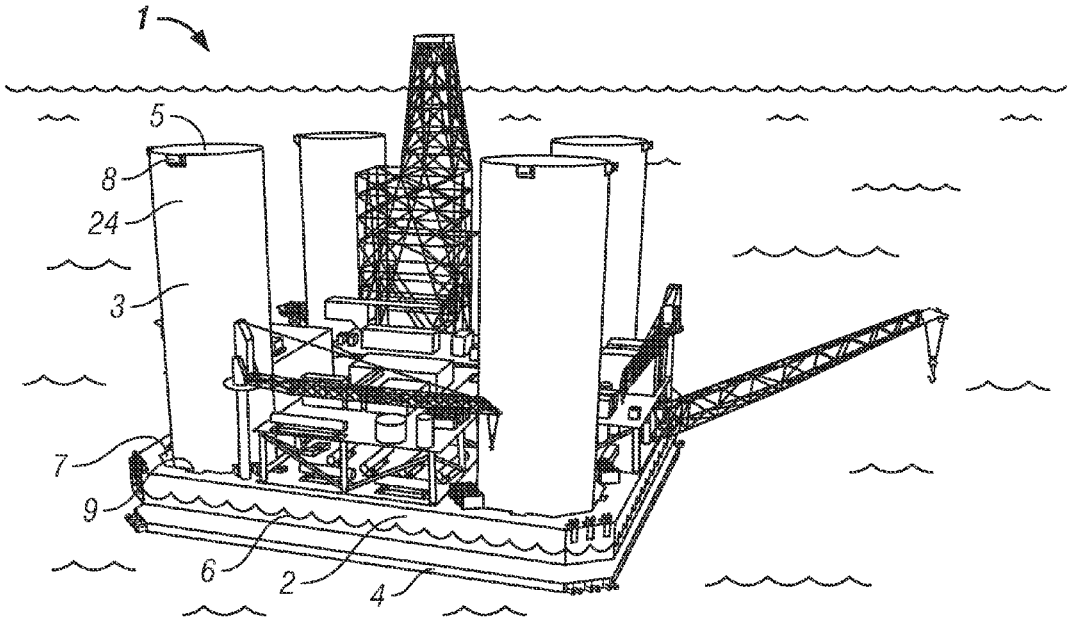
FIG. 1 is a schematic perspective view of an extendable draft platform (EDP) with the columns in a retracted position incorporating a deck-to-column connection assembly disclosed herein.

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location, and from time to time.

While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an alphabetic character after a number to reference a specific member of the numbered element to aid in describing the structures in relation to the Figures, but is not limiting in the claims unless specifically stated. When referring generally to such members, the number without the letter is used. Further, such designations do not limit the number of members that can be used for that function.

The disclosure provides a system and method for locking and unlocking an extendable column to a deck. A deck-to-column connection assembly includes a pawl and shim used in a sequential de-ballasting and ballasting of the column to the deck that can easily lock and unlock the column with the deck. Generally, the locking method includes ballasting the column to insert a pawl between the column and the deck, de-ballasting the column to raise the column relative to the deck and create a vertical gap between the column and the deck, inserting a shim to at least partially fill the gap and secure the pawl in a deployed position, and further de-ballasting the column to raise the deck connected to the column. Generally, the unlocking method includes lowering the deck to float on the water surface by ballasting the columns, then at least partially de-ballasting the column, if required to remove compressive stress on the shim, removing the shim, then ballasting the column, and retracting the pawl.

FIG. 1 is a schematic perspective view of an extendable draft platform (EDP) with the columns in a retracted position incorporating a deck-to-column connection assembly disclosed herein. An EDP 1 includes a buoyant deck 2 having a top surface generally above a water surface 6 and on which conventional equipment and structures for the drilling and/or production of undersea oil and/or gas are mounted. The deck 2 is typically rectangular or square, as shown, but it may be any convenient shape. The deck is provided with a plurality of leg wells 7, which, in a deck 2 that is rectangular or triangular, are generally located near the corners or apices of the deck. Each of the leg wells 7 accommodates a column 3 with a perimeter 24 that can slide within the leg wells 7 for vertical movement therein between a raised position (shown in FIG. 1) and a lower (submerged) position shown in FIG. 3. The columns 3 are of conventional design, being internally divided by longitudinal bulkheads into a plurality of compartments (not shown) and having a top 5. A ballasting system (not shown) is provided for each column 3 for selectively introducing water (ballasting) into the compartments to lower the column and removing (de-ballasting) water therefrom to raise the column. A heave plate 4 is attached to the bottoms of the columns 3 to move up and down relative to the deck 2, as the columns are raised and lowered. As described more fully below, a column cantilever 8 on the column 3 is disposed to be positioned in a deck cantilever guide 9 on the deck 2.

In a raised position, the column internal compartments can be substantially devoid of water (substantially de-ballasted), and the heave plate 4 is in its uppermost position adjacent the bottom of the deck 2. The columns 3 are generally in this position when the EDP 1 is in shallow water or while the EDP is being towed to a selected site in a deeper body of water for deployment or brought to shallow water, for example, to install equipment on the deck.

Figure 2:
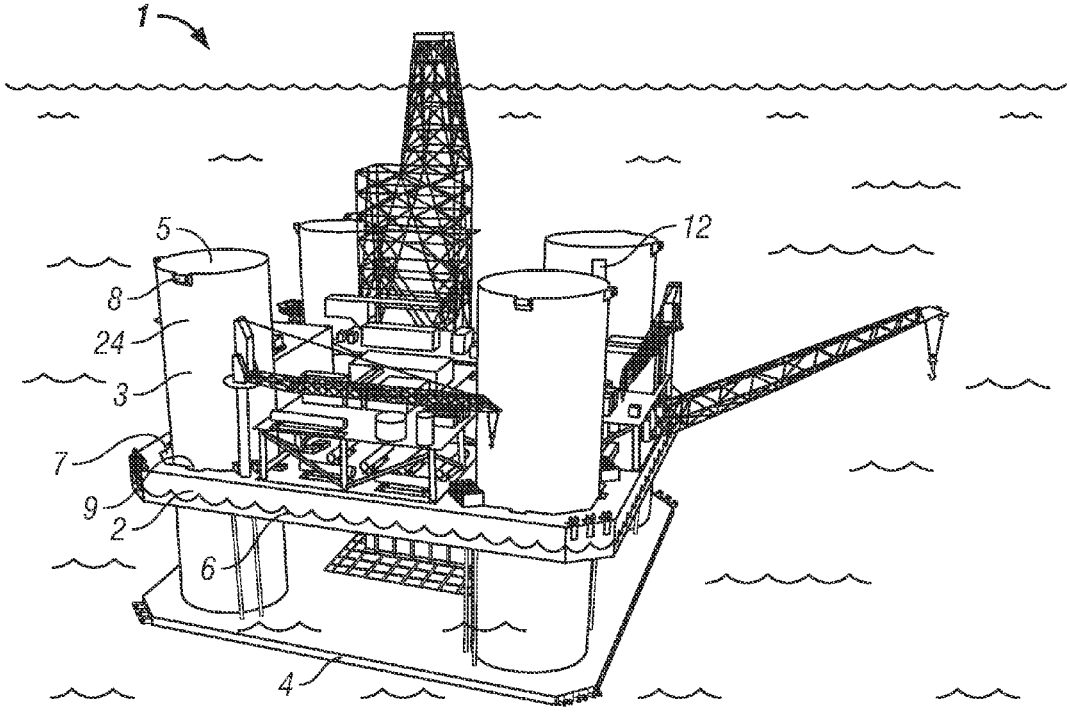
FIG. 2 is a schematic perspective view of the EDP shown in FIG. 1 with the columns in a partially extended position.

FIG. 2 is a schematic perspective view of the EDP shown in FIG. 1 with the columns in a partially extended position. Generally, when the EDP is positioned at the intended site, the columns are ballasted and begin to lower with the heave plate 4 into a partially deployed position.

Figure 3:
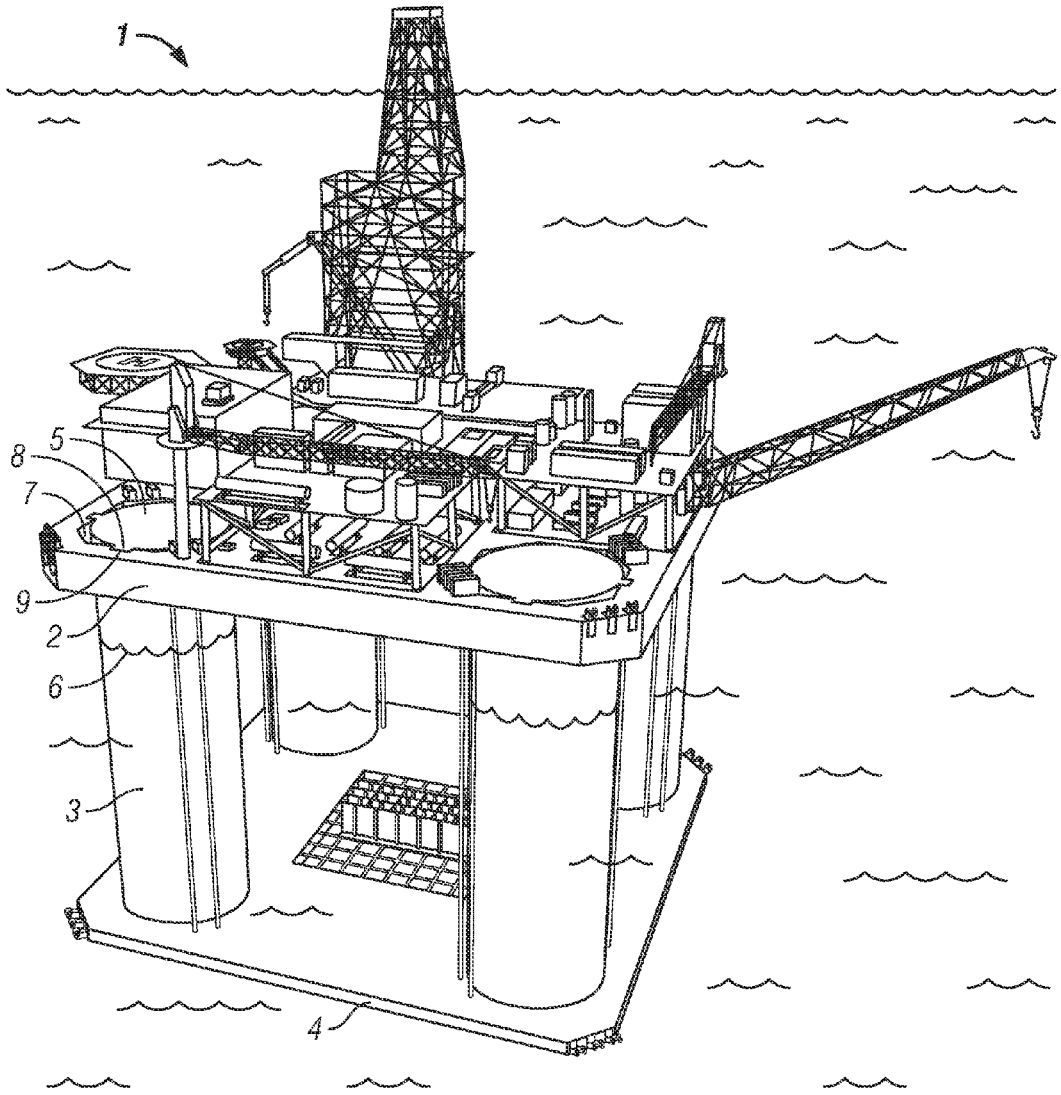
FIG. 3 is a schematic perspective view of the EDP shown in FIG. 1 in an operational position with the columns lowered to a fully extended and deployed position.

FIG. 3 is a schematic perspective view of the EDP shown in FIG. 1 in an operational position with the columns lowered to a fully extended and deployed position. The columns 3 are at or near their lowermost limit of travel within the leg wells 7 of the deck 2. Generally, the lowermost compartments of the columns are filled with water ballast, and some of their intermediate compartments are filled with water ballast. The heave plate 4 is substantially deployed in its lowermost position. When the columns 3 are in their lowered position, they can be connected to the buoyant deck 2 by the deck-to-column connection assembly, as described herein. When connected with the columns, the deck 2 can be lifted above the surface of the water by at least partially de-ballasting the columns, and the EDP 1 is in an operational position.

Figure 4:
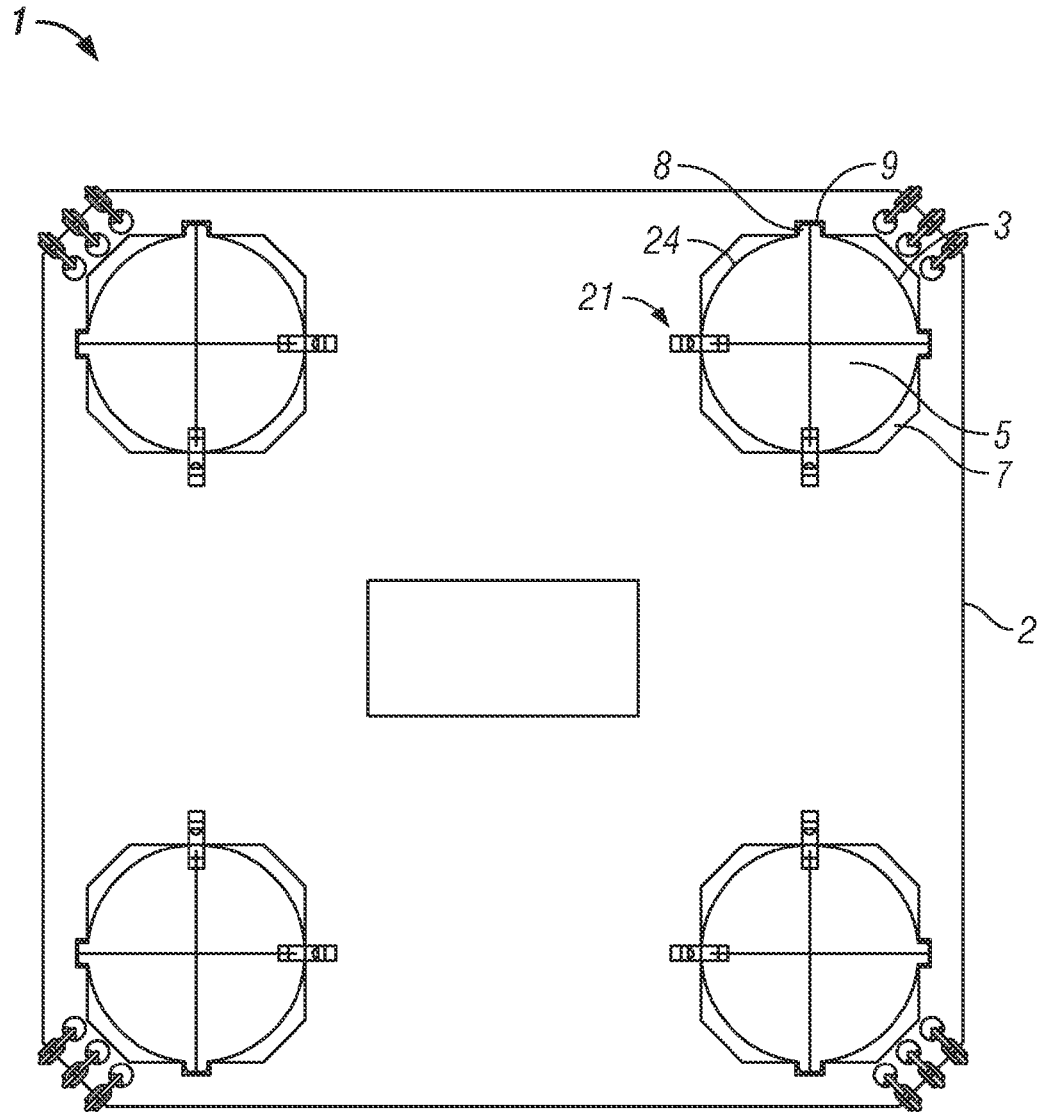
FIG. 4 is a schematic top view of the deck-to-column connection assembly.

FIG. 4 is a schematic top view of the deck-to-column connection assembly. The deck 2 includes a plurality of leg wells 7. One or more (shown as two) column cantilevers 8 can extend radially outward from the perimeter 24 of the columns 3, such as outward from the top 5 of the columns 3, to overlap a surface of the deck 2. In some embodiments, the column cantilevers 8 are designed to fit within recessed surfaces of the deck 2, such as in cantilever column guides 9 formed in the deck 2. These column cantilevers 8 and column guides 9 are also illustrated in FIGS. 1-3 and described in more detail below. One or more (shown as two) deck-to-column connection assemblies 21 can be disposed under the top 5 of each column 3 and on the opposite sides from the column cantilevers 8. Generally, the deck-to-column connection assemblies include a locking pawl and an actuator means for the pawl operating in conjunction with a shim and an actuator means for the shim, described below. A deck pocket, described below, is disposed in each leg well 7 of the deck 2 and designed to receive the locking pawl and lock the columns to the deck.

Figure 5:
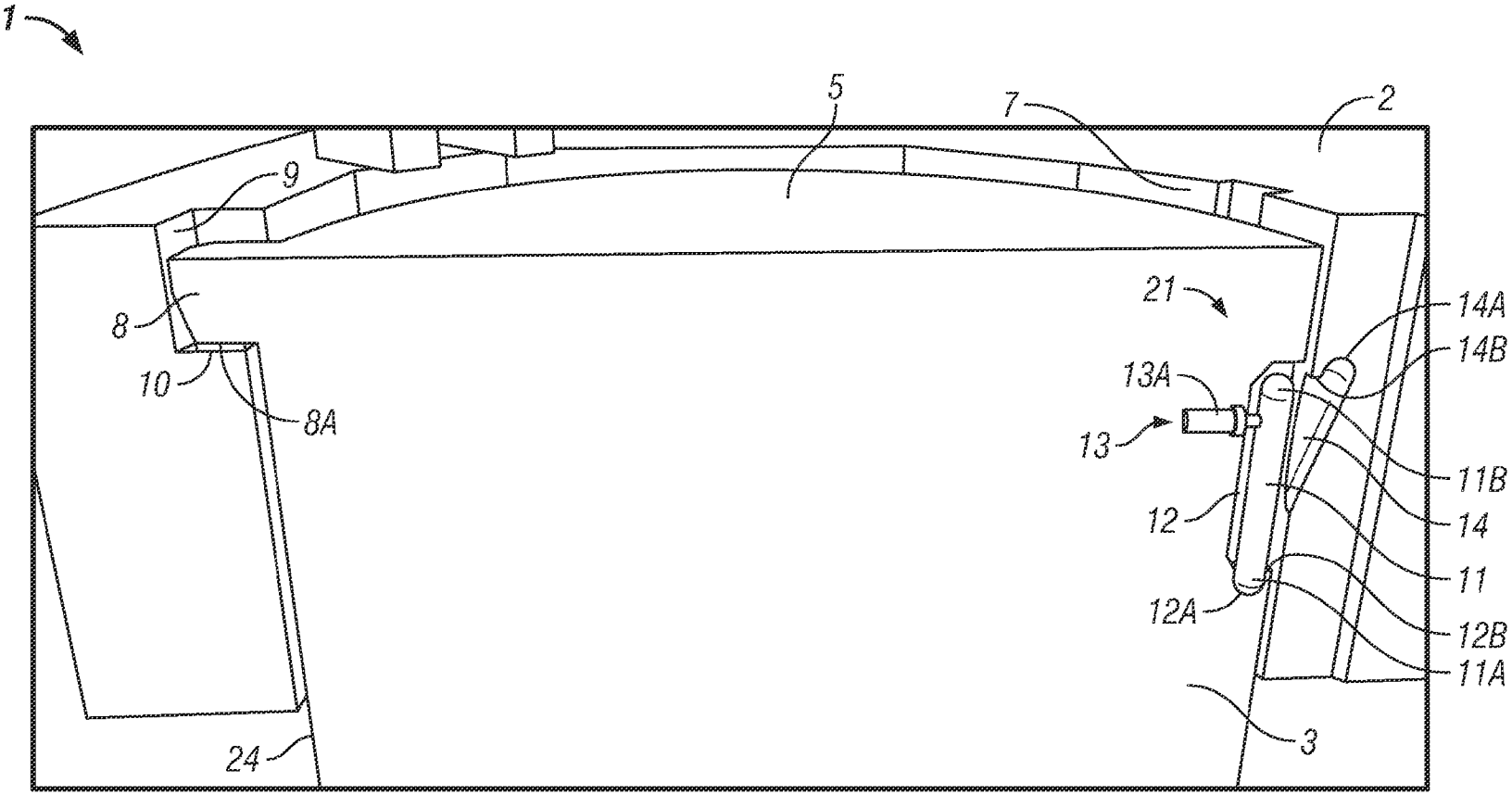
FIG. 5 is a schematic perspective cross-sectional view of the column ballasted into a lowered elevation with the deck-to-column connection assembly retracted.
Figure 8:
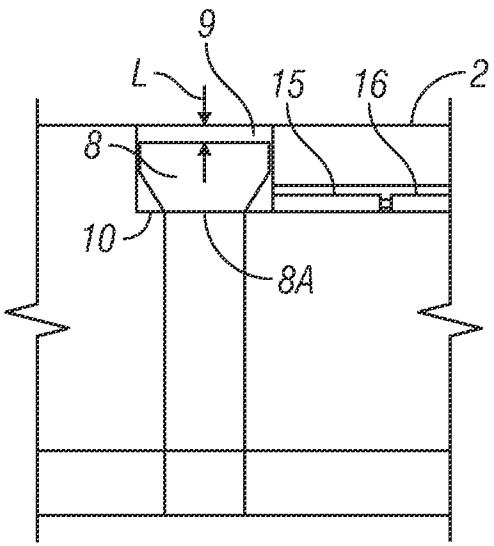
FIG. 8 is a schematic end view of the column cantilever engaged in the cantilever guide of FIG. 6.
Figure 7:
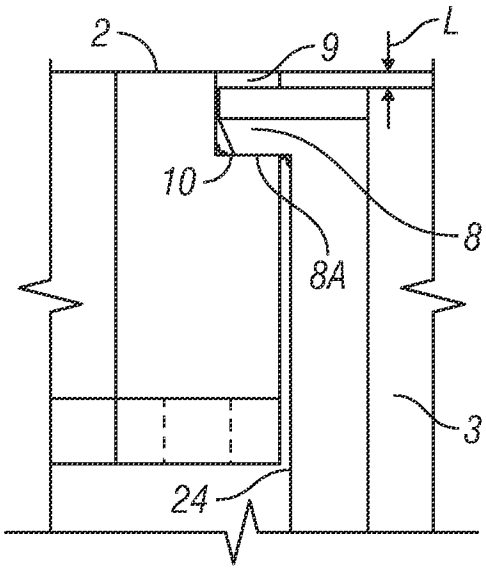
FIG. 7 is a schematic side view of the column cantilever engaged in the cantilever guide of FIG. 6.
Figure 6:
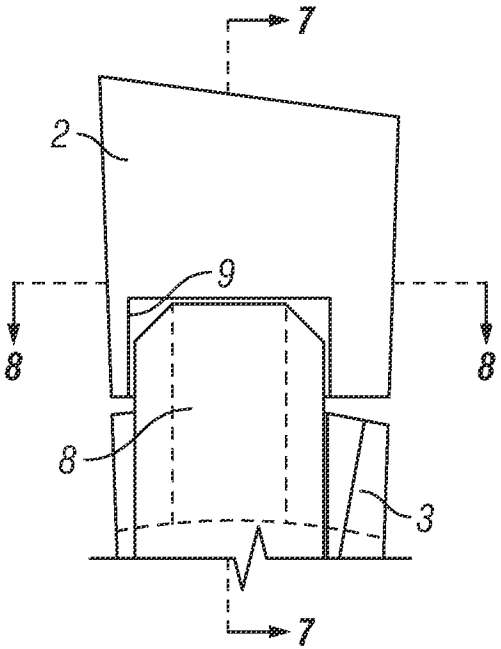
FIG. 6 is a schematic top view of a column cantilever from the column engaged in a cantilever guide in the deck.

FIG. 5 is a schematic perspective cross-sectional view of the column ballasted into a lowered elevation with the deck-to-column connection assembly retracted. FIG. 6 is a schematic top view of a column cantilever from the column engaged in a cantilever guide in the deck. FIG. 7 is a schematic side view of the column cantilever engaged in the cantilever guide of FIG. 6. FIG. 8 is a schematic end view of the column cantilever engaged in the cantilever guide of FIG. 6. The figures will be described in conjunction with each other.

The deck-to-column connection assembly 21 generally includes a locking pawl 11 that can be actuated by a first actuator means 13, which can include powered or manual means to move the pawl. The pawl 11 and actuator means 13 can be generally housed in a column pocket 12 formed in the surface of the perimeter 24 of the column 3. The bottom 12A of the column pocket 12 generally has a partially enclosed chamber with a restraining lip 12B disposed outwardly toward the deck to receive the bottom 11A of the pawl 11, also shown in FIG. 11. The column pocket 12 is circumferentially aligned with a corresponding deck pocket 14 formed in the deck 2. The actuator means 13 can include an actuator 13A and associated controls, and can be hydraulic (such as a hydraulic cylinder), pneumatic (such as a pneumatic cylinder), electrical (such as a solenoid), mechanical (such as a screw jack or rack-and-pinion assembly), or other actuators that can translate an object from one position to another position. The actuator 13A can be coupled to the pawl 11, such that the actuator 13A extends or otherwise moves the top 11B of the pawl toward the deck pocket 14 of the deck 2 for locking the column 3 to the deck 2, while the bottom 11A of the pawl 11 pivots in the bottom of column pocket 12. Alternatively, the deck-to-column connection assemblies could be situated so that the pawl 11 is retracted in the deck pocket 14 and the first actuator means moves the pawl from the deck pocket 14 to the column pocket 12. In either embodiment, the end result is that the pawl is engaged with both the column pocket and the deck pocket.

The process of lowering of the columns will not need to be discussed in detail, because the overall concept is generally disclosed, such as in U.S. Pat. No. 6,718,901 and U.S. Pat. No. 7,037,044. Generally, the tops of the columns are raised higher than the deck in an initial position, for example, suitable for towing to a location. The columns 3 are ballasted down, while the deck 2 floats on the water surface 6 to a first position. The ballasting can continue, until there is no relative movement between deck 2 and column 3 when the column cantilevers 8 are engaged in the cantilever guides 9. The bottom face 8*a* of the column cantilever 8 from the column 3 is supported by the top surface 10 of the cantilever guide 9 in the deck 2. At this time, there is gap "L" between the top of the deck 2 and the top 5 of the column 3. A shim 15 can be laterally disposed relative to the cantilever guide 9 to be positioned by an actuator means 16, which can include powered or manual means to move the shim in final stages of locking the column with the deck, as described herein. The term "shim" is used broadly herein to include any fill material suitable to be inserted in the gap between two surfaces to secure the pawl in the deployed position. Generally, the shim will be made from wear resistant material that can support a compressive load, and can include flexible or hardened material. Thus, the term "lock" for locking the deck with the column herein is used broadly and can include a flexible or rigid connection.

Figure 9:
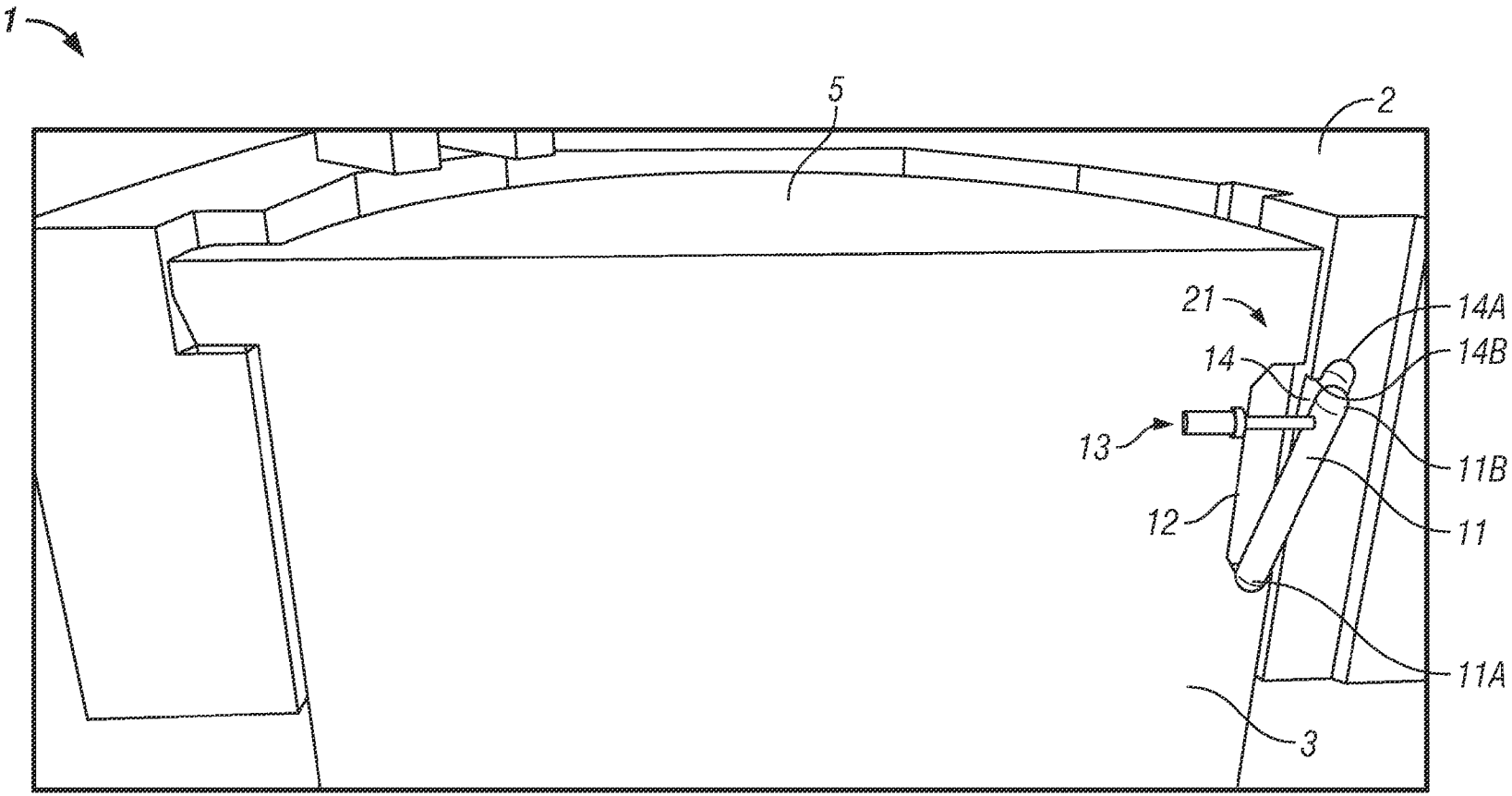
FIG. 9 is a schematic perspective cross-sectional view of a compression pawl of the deck-to-column connection assembly disclosed herein in a deployed position between the column and the deck with the column at a lowered elevation.
Figure 10:
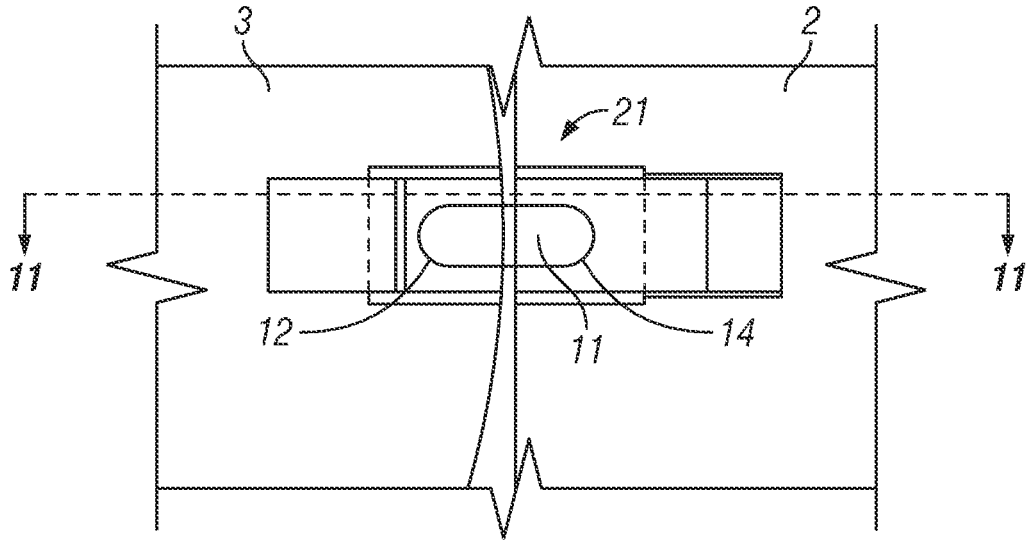
FIG. 10 is a schematic top view of the pawl and the column pocket in the column and the deck pocket in the deck.
Figure 11:
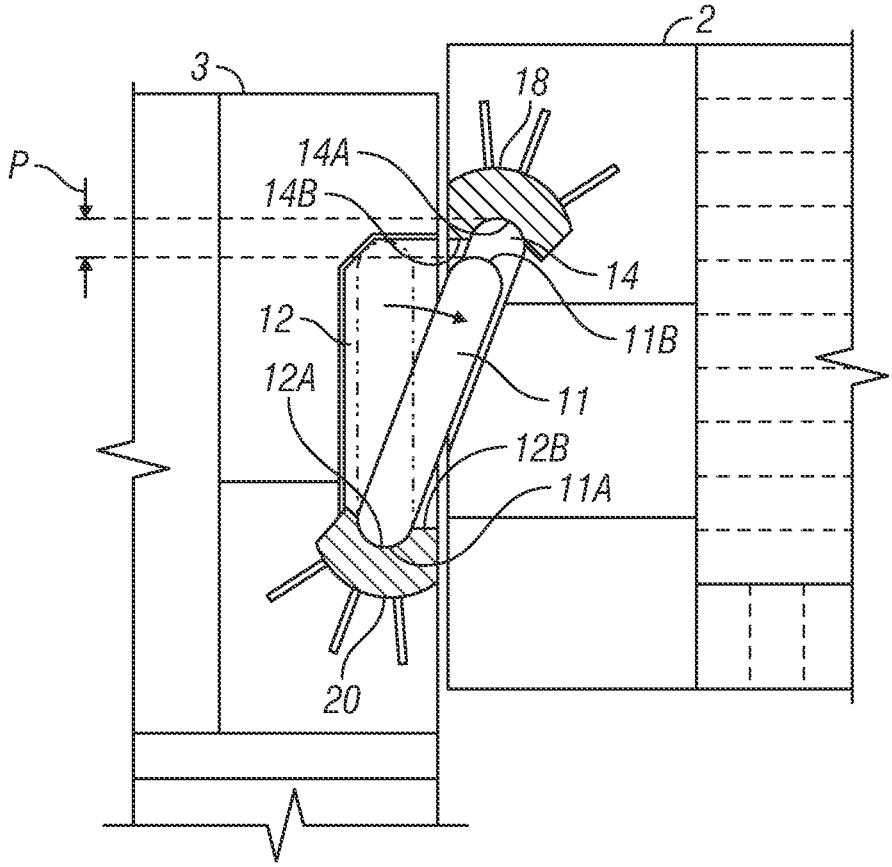
FIG. 11 is a schematic perspective view of the pawl in the deployed position and partially engaged in the deck pocket of the deck.

FIG. 9 is a schematic perspective cross-sectional view of a compression pawl of the deck-to-column connection assembly disclosed herein in a deployed position between the column and the deck with the column at a lowered ballasted elevation. FIG. 10 is a schematic top view of the compression pawl and the column pocket in the column and the deck pocket in the deck. FIG. 11 is a schematic perspective view of the compression pawl in the deployed position and partially engaged in the deck pocket of the deck. The figures will be described in conjunction with each other.

When the column is in a lowered first position due to the ballasting of the column, further downward movement of the column relative to the deck is substantially stopped. Each pawl 11 of the connection assembly 21 is positioned opposite of each deck pocket 14. The actuator means 13 moves the pawl 11 from a retracted position in the column pocket 12 to an inclined position to engage the deck pocket 14 in the deck 2. The top 14A of the deck pocket 14 generally has a partially enclosed chamber with a restraining lip 14B disposed outwardly toward the column to receive the top 11B of the pawl 11. The top 14A is sized so that when the column is lower than the deck by the dimension L, the top of the pawl 11B will pass under the restraining lip 14B of the top 14A of the deck pocket 14. In this lowered, first position of the column relative to the deck, the top 11B of the pawl is lower than the inner surface of the top 14A of the deck pocket 14 by an amount of vertical pocket clearance "P" in this first position. The clearance P can be approximately the amount of the dimension L. Further, as shown in FIG. 11, the top 14A of the deck pocket 14 and the bottom 12A of the column pocket 12 can further include a top pawl support 18 and a bottom pawl support 20, respectively. The pawl supports 18, 20 can be made of wear resistant, hardened material that can support the concentrated compressive load of the pawl on the column and the deck.

Figure 13:
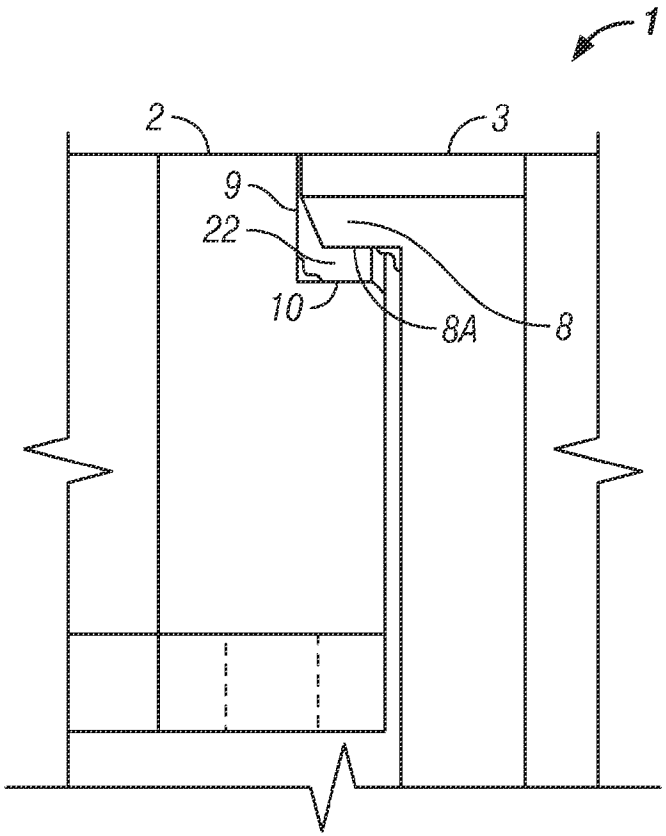
FIG. 13 is a schematic side view of the column cantilever from the column in an elevated position over the cantilever guide in the deck.
Figure 12:
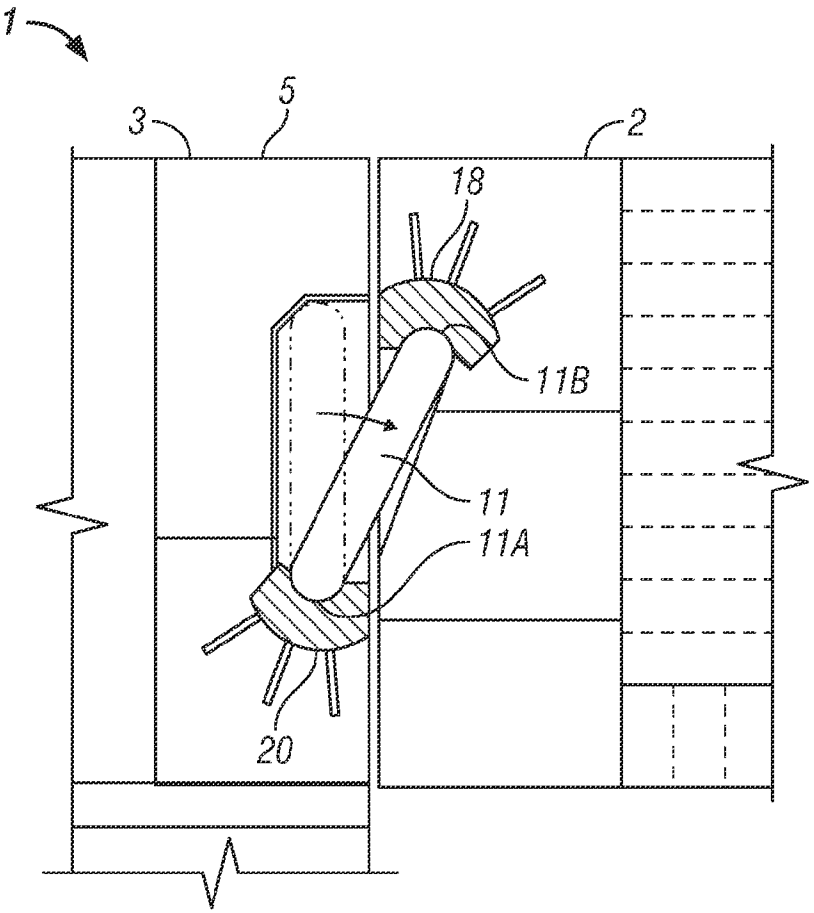
FIG. 12 is a schematic side view of the pawl from the column pocket in a secured position with the deck pocket.

FIG. 12 is a schematic side view of the compression pawl from the column pocket in a secured position with the deck pocket. FIG. 13 is a schematic side view of the column cantilever from the column in an elevated position over the cantilever guide in the deck. The figures will be described in conjunction with each other.

After the pawl is moved sideways to engage the deck pocket 14 in the deck 2, the columns 3 can be at least partially de-ballasted to raise the columns relative to the deck 2 to a second position higher than the first position. In the second position, the top 5 of the column 3 can be substantially level with the top of the deck 2. The vertical pocket clearance P is at least partially reduced, and the bottom face of the column cantilever 8 on the column 3 is moved upward from the top 10 of the cantilever guide 9 on the deck 2, leaving a gap 22. The amount of the gap 22 is restricted by the amount of the vertical pocket clearance P in the first position. In this second position, the pawl is engaged between the column pocket and the deck pocket. The bottom 11A of pawl 11 can be engaged with the bottom pawl support 20 of the column pocket 12, and the top 11B of the pawl can be engaged with the top pawl support 18 of the deck pocket 14. With further de-ballasting, the pawl 11 will start to pass the load of the deck 2 to the columns 3.

Figure 14:
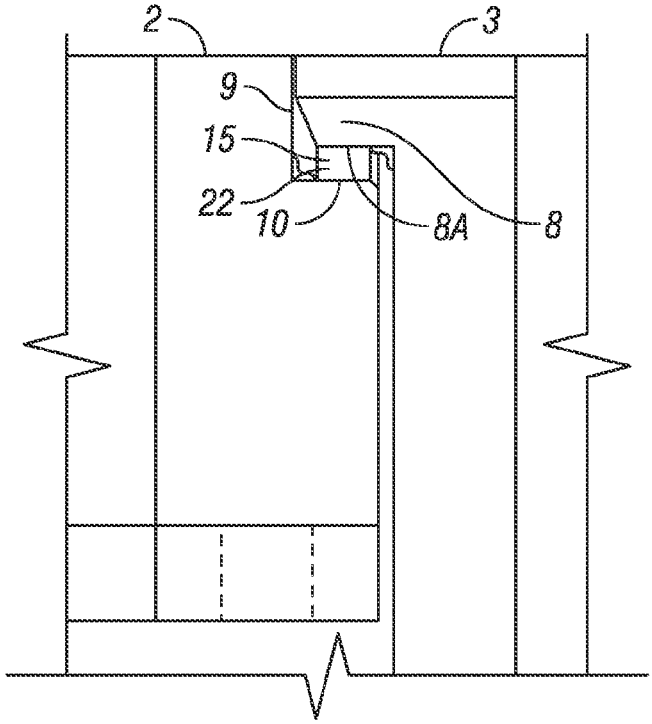
FIG. 14 is a schematic side view of a shim between the column cantilever from the column and the column guide in the deck.
Figure 15:
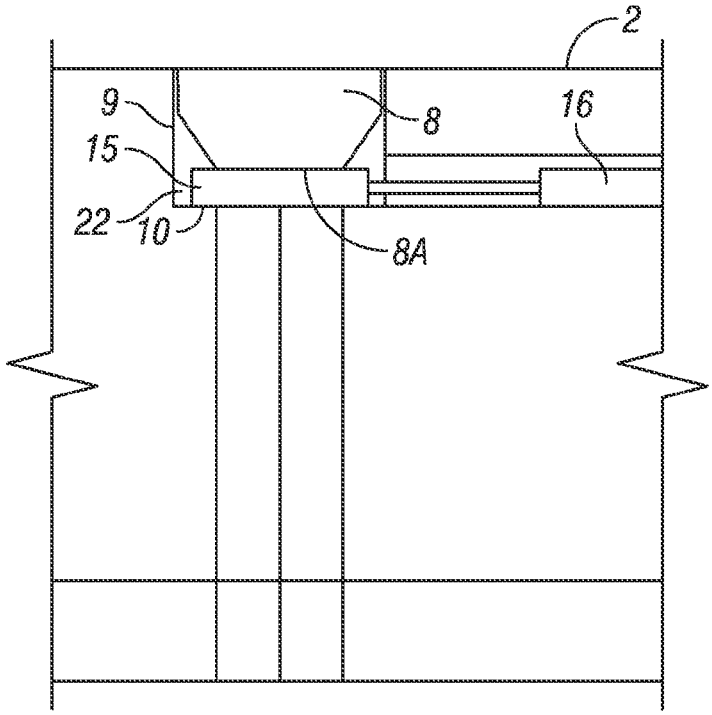
FIG. 15 is a schematic front view of the shim between the column cantilever from the column and the column guide in the deck shown in FIG. 14.
Figure 16:
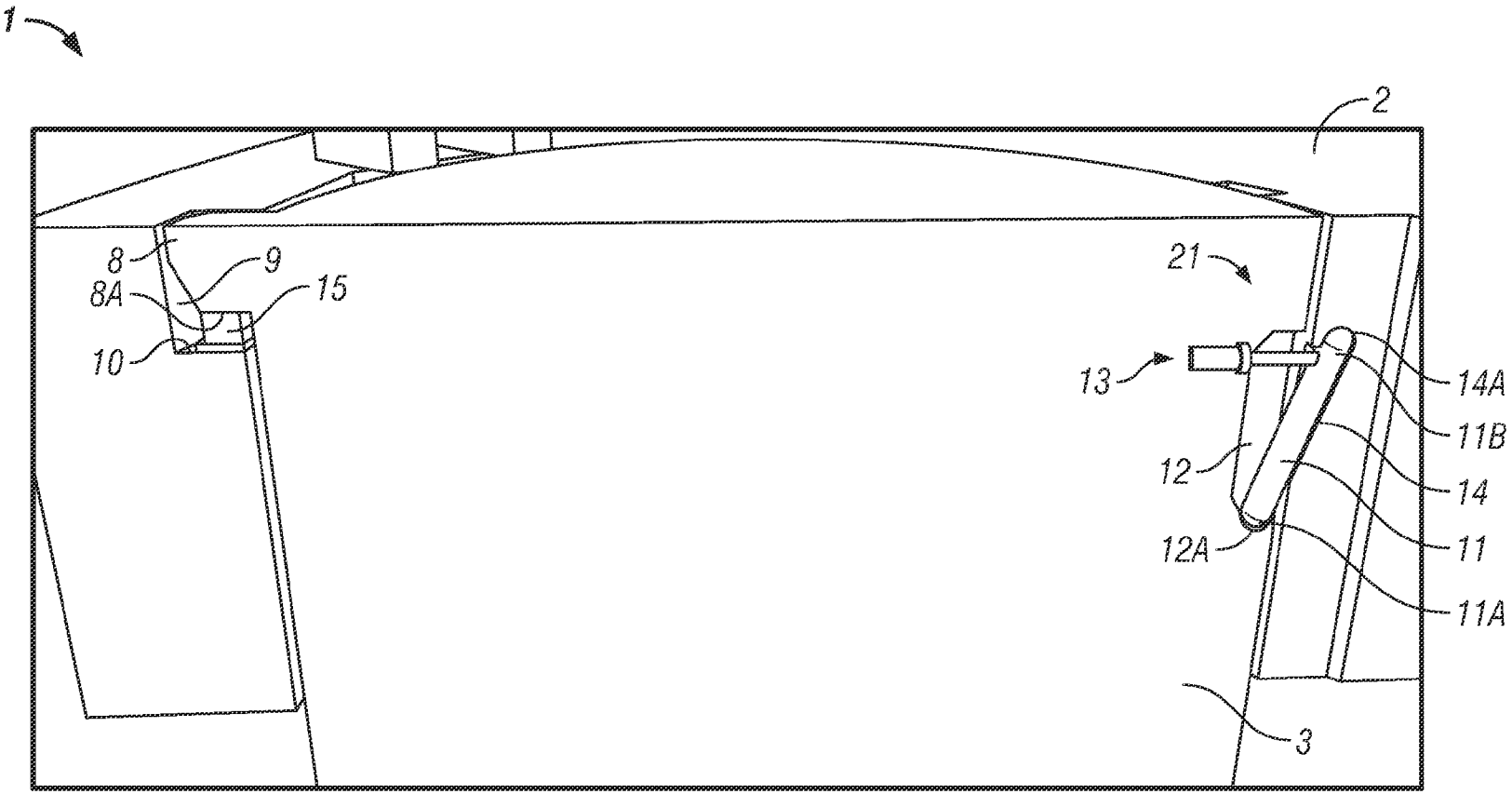
FIG. 16 is a schematic perspective view of the column locked into position to the deck using the deck-to-column connection assembly.

FIG. 14 is a schematic side view of a shim between the column cantilever from the column and the column guide in the deck. FIG. 15 is a schematic front view of the shim between the column cantilever from the column and the column guide in the deck shown in FIG. 14. FIG. 16 is a schematic perspective view of the column locked into position to the deck using the deck-to-column connection assembly. The figures will be described in conjunction with each other.

When the movement is stabilized between the column and the deck in the at least partially de-ballasted condition of the column, there is little or no relative movement between the deck and column. The shim 15 that is stored in the deck 2, as referenced above in FIG. 8, can be deployed by an actuator means 16 into the gap 22. Like the actuator means 13, the actuator means 16 can include a variety of types of actuators and controls that can translate an object from one position to another position. The shim 15 is inserted between the bottom face 8A of the column cantilever 8 and the top 10 of the cantilever guide 9 to at least partially fill the gap 22.

Because the shim 15 restricts downward movement of the column 3 relative to the deck 2, and the pawl 11 restricts upward movement of the column relative to the deck, the amount of clearance P that was in the first position can no longer be available. The pawl is secured into position. The shim 15 helps secure the pawl 11 between the deck and the column to lock the column 3 with the deck 2, even with the column attempting to move downward relative to the deck, such as in rough seas.

Once the shim 15 is deployed, the actuator means 16 is no longer needed to maintain the engagement of the column 3 to the deck 2 in such a locked condition. The shim 15 is in a stable position and in a partially enclosed position between the walls of the cantilever guide and the column cantilever, and suited for a compressive load caused by movement of the column 3 downward relative to the deck 2. Further, the pawl 11 is in a stable position in the partially enclosed column pocket 12 and deck pocket 14 and suited for a compressive load caused from movement of the column 3 upward relative to the deck 2.

The columns 3 can continue to be de-ballasted to raise the deck 2 until the EDP 1 reaches its design draft, such as shown in FIG. 3. The deck 2 may sag once it is out of water. In at least one embodiment, the disclosure shows the pawls and their respective deck and column pockets located inwardly toward the center of the deck and away from the outer perimeter of the deck. It is believed that as the deck sags, the inwardly disposed pawls and pockets provide a more secure placement to help the deck stay locked with the columns. Further, the clearances in the deck leg wells and columns, and if applicable, any deck sag, may cause the columns to slightly tilt at an angle relative to the deck and cause a horizontal engagement between the perimeter of the column and the corresponding leg well surrounding surfaces, further causing the deck and column to become engaged more firmly together. In this and other positions, the column cantilever 8 on the column 3 may exert a compressive load on the shim 15 in the cantilever guide 9 of the deck 2, and a horizontal load on the cantilever guide 9 of the deck 2.

To release the column 3 from the deck 2, there is no need to cut off any weldments or to carefully balance the ballast in the column to release both upward and downward shear stresses on any connecting pins in order to release the pins. The column can be ballasted to lower the deck to the water surface for floating the deck on the surface, if the deck is initially above the water surface. The actuator means 16 can remove the shim 15 from the gap 22 between the column cantilever 8 and the cantilever guide 9. If there is a compressive load on the shim 15, the column 3 can be at least partially de-ballasted to raise the column relative to the deck 2 without requiring an exactitude of ballasting and balancing the ballast, because the maximum upward movement is still restrained by the pawl 11. Once the shim 15 is removed, the column 3 can be ballasted to lower the column relative to the deck 2, so the pawl 11 can be retracted from the deck pocket 14 back into the column pocket 12. The column 3 is unlocked from the deck 2. The column 3 can then be de-ballasted to raise the column 3 relative to the deck 2, such as for towing to a new location and subsequent deployment of the offshore platform.

Other and further embodiments utilizing one or more aspects of the inventions described above can be devised without departing from the spirit of the invention. For example, different shaped pawls, columns, leg wells, different actuators, and even a reversely directed pawl operated from the deck into the column can in like fashion restrict the movement of the column relative to the deck in a similar procedure. Further, other types of semi-submersible platforms can be used that have a column that is movable vertically relative to a deck. Other variations in the system are possible. Further, the various methods and embodiments described herein can be included in combination with each other to produce variations of the disclosed methods and embodiments. The order of steps can occur in a variety of sequences unless otherwise specifically limited. The various steps described herein can be combined with other steps, interlineated with the stated steps, and/or split into multiple steps. Elements have been described functionally and can be embodied as separate components or can be combined into components having multiple functions.

Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The invention has been described in the context of preferred and other embodiments and not every embodiment of the invention has been described. Apparent modifications and alterations to the described embodiments are available to those of ordinary skill in the art given the disclosure contained herein. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A method of locking and unlocking an extendable column with a deck for an offshore floating platform with a deck-to-column connection assembly, the column having a top and a perimeter surface and a column pocket formed in the perimeter surface, the deck having a deck pocket circumferentially aligned with the column pocket, and the deck-to-column connection assembly having a pawl coupled to the column or deck and selectively retractable in the column pocket or deck pocket, a first actuator coupled to the pawl, a column cantilever extending outward from the column beyond the column perimeter and overlapping a recessed deck surface, a removable shim, and a second actuator coupled to the shim, the method comprising:

when the column is in an at least partially ballasted first position, moving a pawl sideways with the first actuator so that the pawl is engaged in both the column pocket and the deck pocket with an amount of vertical pocket clearance remaining in at least one of the pockets;

at least partially de-ballasting the column to a second position to decrease the amount of vertical pocket clearance from the first position;

creating a gap between the column cantilever and the recessed deck surface limited by the amount of vertical pocket clearance in the first position; and inserting the shim in the gap with the second actuator, thereby restraining the column from moving relative to the deck to increase the vertical pocket clearance to the amount in the first position, and thereby securing the pawl within the column pocket and the deck pocket to lock the column with the deck.

2. The method of claim 1, further comprising de-ballasting the column to raise the deck to an operational height for the offshore platform.

3. The method of claim 1, further comprising unlocking the column with the deck, comprising:

removing the shim from the gap;

at least partially ballasting the column relative to the deck to lower the column relative to the deck;

retracting the pawl from an engagement with both pockets, thereby unlocking the column with the deck.

4. The method of claim 1, further comprising de-ballasting the unlocked column to raise the column to an elevated position above the deck.

5. The method of claim 1, further comprising locking and unlocking a plurality of columns to the deck.

6. The method of claim 1, wherein the column has a plurality of deck-to-column assemblies located at a plurality of locations around the perimeter of the column and diametrically opposite to a plurality of column cantilevers around the column.

7. The method of claim 1, further comprising de-ballasting the column into an initial position with a top of the column above the buoyant deck.

8. The method of claim 1, further comprising ballasting the column to the first position with the top of the column below the deck.

9. The method of claim 1, further comprising de-ballasting the column to the second position with the top of the column substantially level with the deck.

10. A system for locking and unlocking an extendable column with a deck for an offshore floating platform, comprising:

a column capable of being ballasted and de-ballasted, the column having a perimeter surface and a column pocket formed in the perimeter surface;

a buoyant deck capable of being connected with the column, the deck having a deck pocket circumferentially aligned with the column pocket; and a deck-to-column connection assembly, comprising:

a pawl coupled to the column or deck and selectively retractable in the column pocket or deck pocket and selectively engagable with the deck pocket or column pocket, respectively;

a first actuator coupled to the pawl to move the pawl between a retracted position and extended position relative to the pockets;

a column cantilever extending outward from the column beyond the column perimeter and overlapping a recessed deck surface;

a removable shim; and a second actuator coupled to the shim and capable of inserting the shim between the column cantilever and the recessed deck surface to lock the pawl in the column pocket and the deck pocket.

11. The system of claim 10, wherein the recessed deck surface comprises a recessed cantilever guide formed in the deck and aligned with the column cantilever to receive the column cantilever when the column and deck are locked together.

12. The system of claim 11, wherein the shim is at least partially restrained in position between one or more walls of the cantilever guide of the deck and the column cantilever of the column.

13. The system of claim 10, wherein each of the column pocket and deck pocket are formed with a restraining lip for the pawl.

14. The system of claim 10, wherein the pawl is disposed in the column pocket while retracted.

15. The system of claim 10, wherein the column has a plurality of deck-to-column assemblies located at a plurality of locations around the perimeter of the column and diametrically opposite to a plurality of column cantilevers around the column.

16. A system for locking and unlocking an extendable column with a deck for an offshore floating platform, comprising:

a column capable of being ballasted and de-ballasted, the column having a perimeter surface and a column pocket formed in the perimeter surface;

a buoyant deck capable of being connected with the column, the deck having a deck pocket circumferentially aligned with the column pocket; and a deck-to-column connection assembly, comprising:

a pawl coupled to the column or deck and selectively retractable in the column pocket or deck pocket and selectively engagable with the deck pocket or column pocket, respectively;

a first actuator coupled to the pawl to move the pawl between a retracted position and extended position relative to the pockets;

a column cantilever extending outward from the column beyond the column perimeter and overlapping a cantilever column guide formed in the deck;

a removable shim; and a second actuator coupled to the shim and capable of inserting the shim between the column cantilever and the cantilever column guide to lock the pawl in the column pocket and the deck pocket.

* * * * *